US006589021B2

(12) United States Patent
Kato et al.

(10) Patent No.: US 6,589,021 B2
(45) Date of Patent: Jul. 8, 2003

(54) SINGLE-HEADED PISTON TYPE SWASH PLATE COMPRESSOR

(75) Inventors: Takayuki Kato, Kariya (JP); Takahiro Sugioka, Kariya (JP); Toshihisa Shimo, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/903,794

(22) Filed: Jul. 12, 2001

(65) Prior Publication Data

US 2002/0006338 A1 Jan. 17, 2002

(30) Foreign Application Priority Data

Jul. 14, 2000 (JP) ..... 2000-214234

(51) Int. Cl.[7] ..... F04B 1/26
(52) U.S. Cl. ..... 417/222.2; 92/71
(58) Field of Search ..... 417/222.2, 469; 92/71, 129

(56) References Cited

U.S. PATENT DOCUMENTS 4,268,225 A * 5/1981 Nakayama et al. ..... 417/269
4,617,856 A 10/1986 Miller et al. ..... 92/71
4,641,570 A * 2/1987 Futamura et al. ..... 92/71
4,662,267 A * 5/1987 Kaku et al. ..... 92/71
4,683,804 A * 8/1987 Futamura et al. ..... 92/71
6,189,434 B1 * 2/2001 Kawaguchi et al. ..... 92/71
6,308,615 B1 * 10/2001 Takenaka et al. ..... 92/129

* cited by examiner

*Primary Examiner*—Teresa Walberg
*Assistant Examiner*—Leonid Fastovsky
(74) *Attorney, Agent, or Firm*—Woodcock Washburn LLP

(57) ABSTRACT

A single-headed piston type swash plate compressor, realizing a lighter weight, provided with a housing internally defining and forming cylinder bores, a crank chamber, a suction chamber, and a discharge chamber; single-headed pistons accommodated in the cylinder bores to be able to reciprocate therein; a drive shaft driven by an external drive source and supported rotatably by the housing; a swash plate supported by the drive shaft to be rotated synchronously with the drive shaft; and a pair of shoes provided at the front and rear of the swash plate for driving the pistons; wherein the shoes are mainly comprised of a resin.

7 Claims, 3 Drawing Sheets

SINGLE-HEADED PISTON TYPE SWASH PLATE COMPRESSOR

BACKGROUND OF THE INVENTION

1. Field of the Invention

The present invention relates to a single-headed piston type swash plate compressor used for a vehicle air-conditioning system etc.

2. Description of the Related Art

The refrigeration circuit used in a vehicle air-conditioning system includes a compressor for compressing a refrigerant gas. This compressor comes in various forms such as variable displacement types and fixed displacement types. More specifically, fixed displacement type compressors include not only single-headed piston type swash plate compressors, but also double-headed piston type swash plate compressors. Variable displacement type compressors also include not only single-headed piston type swash plate compressors, but also double-headed piston type swash plate compressors.

Among these compressors, a general single-headed piston type swash plate compressor defines and forms inside its housing cylinder bores, a crank chamber, a compression chamber, a suction chamber, and a discharge chamber. Each cylinder bore accommodates a single-headed piston so that it may reciprocate. Further, a drive shaft supported rotatably by the housing is driven by an engine or another external drive source. The swash plate is supported by the drive shaft to be able to synchronously rotate with the drive shaft. A pair of shoes is accommodated in a pair of shoe seats provided at an engagement portion in the piston, to drive the piston and is provided at the front and rear of the swash plate.

Here, since each piston is a single-headed piston having a head at only one of the front and rear of the swash plate, the compressor is a single-headed piston type swash plate compressor. Further, if the swash plate is provided at a certain inclination angle with respect to the drive shaft, the compressor is a fixed displacement single-headed piston type swash plate compressor. If the swash plate is provided to be variable in the inclination angle with respect to the drive shaft and the pressure in the crank chamber can be adjusted by a control valve to change the inclination angle and adjust the discharge capacity, it is a variable displacement single-headed piston type swash plate compressor.

In this single-headed piston type swash plate compressor, if the drive shaft is driven by an external drive source, the swash plate synchronously rotates, so the pistons reciprocate in the cylinder bores. Due to this, each cylinder bore forms a compression chamber with the head of the piston, so when the piston is in the suction stroke, low pressure refrigerant gas is sucked into the compression chamber from the suction chamber connected to an evaporator of the refrigeration circuit. When the piston is in the compression stroke, high pressure refrigerant gas is discharged to the discharge chamber from the compression chamber. This discharge chamber is connected to a condenser of the refrigeration circuit. The refrigeration circuit is used as a vehicle air-conditioning system for air-conditioning a vehicle. During this time, in the swash plate compressor, the slidability of the sliding portions between the swash plate and the shoes is ensured by a mist of lubricating oil contained in the refrigerant gas.

In the above single-headed piston type swash plate compressors of the related art, however, the shoes were mainly comprised of a ferrous material, such as SUJ2 according to the Japan Industrial Standards (JIS), and had the disadvantage that they were heavy. This disadvantage was present in both fixed displacement swash plate compressors and variable displacement swash plate compressors.

SUMMARY OF THE INVENTION

An object of the present invention is to provide a lighter single-headed piston type swash plate compressor.

According to the present invention, there is provided a single-headed piston type swash plate compressor comprised a housing internally defining and forming cylinder bores, a crank chamber, a suction chamber, and a discharge chamber; a drive shaft driven by an external drive source and supported rotatably by the housing; a swash plate supported by the drive shaft to be rotated synchronously with the drive shaft; a single-headed piston accommodated in each of the cylinder bores to be able to reciprocate therein and to define a compression chamber therein; and a pair of shoes provided at the front and rear of the swash plate so as to be accommodated in the piston and to drive the piston; wherein the shoes are mainly comprised of a resin.

Preferably, each shoe is impregnated with a lubricating oil.

Preferably, the inclination angle of the swash plate is variable with respect to the drive shaft and the pressure in the crank chamber can be adjusted by a control valve to change the inclination angle and to adjust the amount of discharge capacity.

Preferably, the swash plate is comprised of a swash plate substrate made of a first metal and a coating formed on the front and rear surfaces of the swash plate substrate for improving the slidability with the first metal.

Preferably, the piston is comprised of a piston substrate made of an aluminum-based material and a coating made of tin plating formed on the shoe seat of the piston substrate, and a semi-spherical convex surface of the shoe and a semi-spherical concave surface of the shoe seat slide against each other.

Preferably, the swash plate is comprised of a swash substrate made of a ferrous material and aluminum sprayed layers formed on the front and rear surface of the swash plate substrate, and resin coats are formed on the aluminum sprayed layers.

BRIEF DESCRIPTION OF THE DRAWINGS

These and other objects and features of the present invention will be more apparent from the following description, with reference to the accompanying drawings, wherein.

DESCRIPTION OF THE PREFERRED EMBODIMENTS

Figure 1:
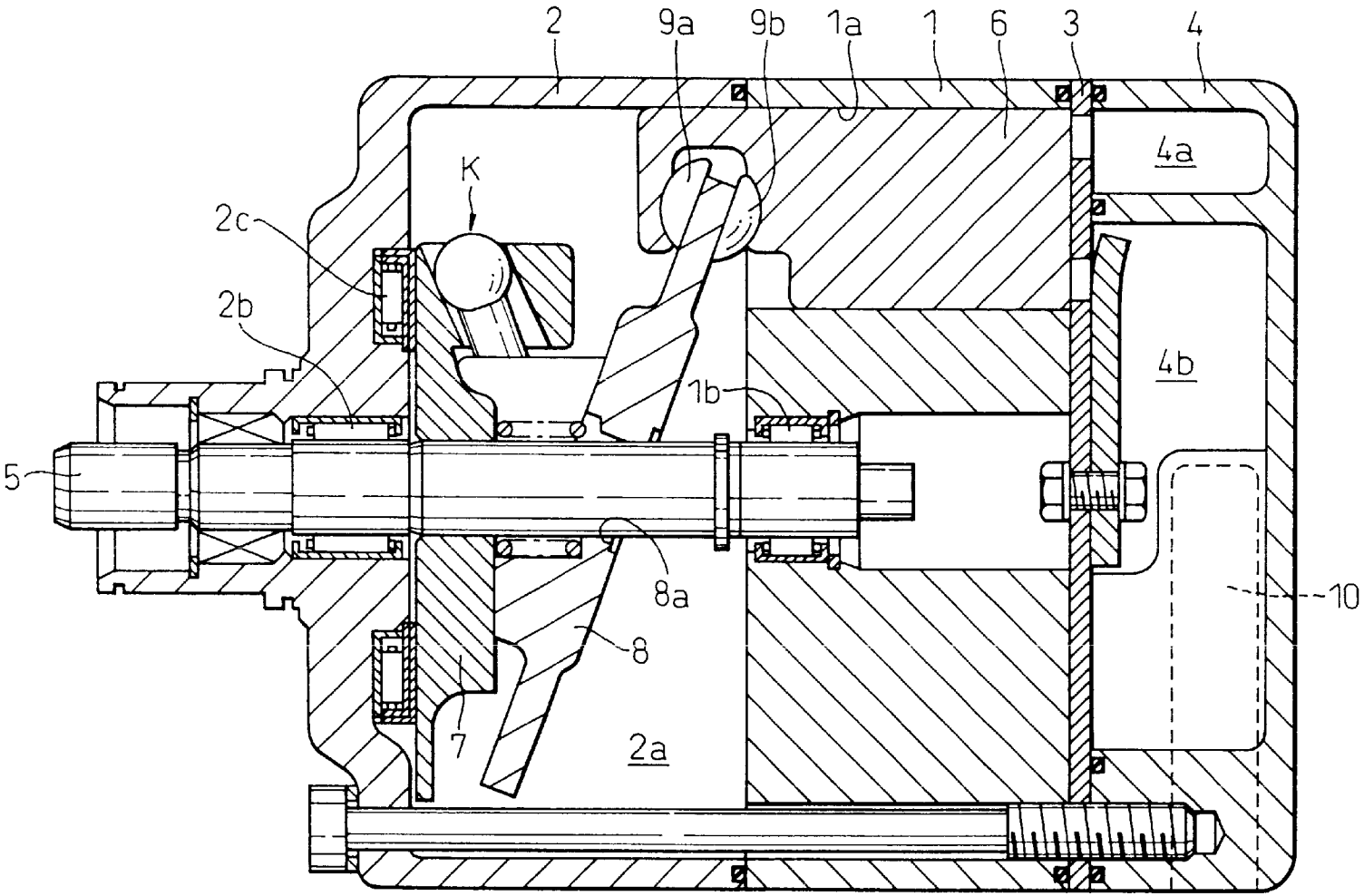
FIG. 1 is a sectional view of a variable displacement single-headed piston type swash plate compressor according to an embodiment of the present invention.

The single-headed piston type swash plate compressor according to the present invention is provided with a housing internally defining and forming cylinder bores, a crank chamber, a compression chamber, a suction chamber, and a discharge chamber; single-ended pistons accommodated in each cylinder bore and able to reciprocate therein; a drive shaft driven by an external drive source and rotatably supported by the housing; a swash plate supported by the drive shaft to be rotated synchronously with the drive shaft; and a pair of shoes provided at the front and rear of the swash plate for driving the piston; wherein the shoes are mainly comprised of a resin.

The single-headed piston type swash plate compressor of the present invention is smaller in weight since the shoes are mainly comprised of a resin.

As the resin, it is possible to use polyamide imide (PAI), polyimide (PI), polyetheretherketone (PEEK), a phenol resin (PF), an epoxy resin (EP), polyphenylene sulfide (PPS), or another resin having a heat resistance of at least 130° C. To improve the abrasion resistance or to reduce the heat expansion coefficient, it is possible to disperse a carbon fiber or glass fiber etc.

It is also possible to form shoes by a resin in a manner giving continuous pores and impregnate the pores with a lubricating oil. By doing this, it is possible to ensure the slidability of the sliding portions between the swash plate and shoes and between the shoes and the shoe seats of the pistons.

The single-headed piston type swash plate compressor of the present invention is particularly effective in the case of a variable displacement type where the inclination angle of the swash plate is provided to be variable with respect to the drive shaft and the pressure inside the crank chamber is adjusted by a control valve so as to change the inclination angle and adjust the discharge capacity. That is, since the shoes are mainly comprised of a resin, the inertia of the shoes acting in a direction increasing the inclination angle becomes smaller and the high speed controllability is improved.

The swash plate is preferably comprised of a swash plate substrate made of a first metal and coatings formed on the front and rear surfaces of the swash plate substrate for improving the slidability with the first metal. By doing this, it is possible to prevent abrasion of the coating formed on the surface of the swash plate substrate under severe conditions and achieve a superior durability whether the single-headed piston type swash plate compressor is a fixed capacity type or a variable capacity type.

That is, the swash plate substrate is comprised of a first metal. As the first metal, it is possible to use a metal having a large specific gravity and a superior strength such as a ferrous material (meaning iron or an iron alloy containing mostly iron, same below), a copper-based material (meaning copper or a copper alloy containing mostly copper, same below), a nickel-based material (meaning nickel or a nickel alloy containing mostly nickel, same below), or a molybdenum-based material (meaning molybdenum or a molybdenum alloy containing mostly molybdenum, same below).

The front and rear surfaces of the swash plate substrate can be formed with the following coatings (1) to (8), that is, (1) a sprayed layer of a metal able to improve the slidability such as a copper-based material or aluminum-based material (meaning aluminum or an aluminum alloy mostly containing aluminum, same below), (2) a sintered layer of a metal able to improve the slidability such as a copper-based material or aluminum-based material, (3) a coating layer comprised of polyamide imide (PAI), polyimide (PI), polyetheretherketone (PEEK), or another resin having a heat resistance of at least 130° C. in which is dispersed a solid lubricant such as molybdenum disulfide ($MoS_2$), graphite, tungsten disulfide ($WS_2$), boronitride (BN), and polytetrafluoroethylene (PTFE), (4) a plating layer of a metal able to improve the slidability such as tin plating, nickel-phosphorus plating, nickel-boron plating, nickel-phosphorus-boron plating, nickel-phosphorus-boron-tungsten (Ni—P—B—W) plating, nickel-phosphorus-boron-tungsten-chrome plating, and hard chrome plating, (5) an ion plating layer obtained by chemical vapor deposition (CVD) or physical vapor deposition (PVD) of a material able to improve the slidability such as titanium nitride (TiN), chrome nitride (CrN), and titanium-aluminum-nitride (TiAlN); (6) a layer comprised of diamond-like carbon (DLC) etc., (7) a ceramic coat, and (8) alumite. When not forming a coating on the front surface or rear surface of the swash plate substrate, it is preferable to quench-harden the front surface or the rear surface.

Figure 3:
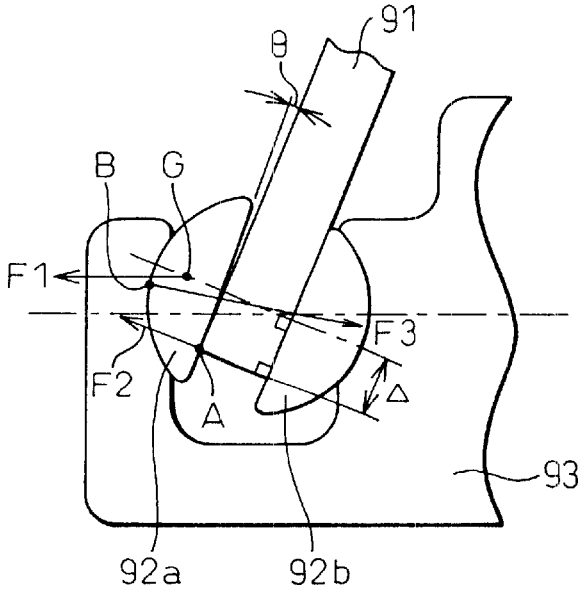
FIG. 3 is an enlarged sectional view of the principal parts of a swash plate, shoes, and a piston according to a general variable displacement single-headed piston type swash plate compressor.

Further, in a single-headed piston type swash plate compressor, as shown in FIG. 3, when the swash plate 91 is positioned at the bottom dead center, an inertia F1 due to the weight of a shoe 92*a* acts on the center of gravity G in the axial direction. Therefore, the shoe 92*a* receives a reaction force F3 corresponding to the resultant force of the inertial force F1 from the center of gravity G and a normal reaction force F2, which acts perpendicularly to a front side edge A and shifts by the direction Δ from the regular position towards the outside of the swash plate. Thus, the shoe 92*a* receives the force F3 at the position B that connects to the shoe seat placed in the front side of the piston. The inertia F1 differs according to the specific gravity of the shoe 92*a* and the rotational speed of the drive shaft, so the normal force F2 also differs depending on the specific gravity of the shoe 92*a* and the rotational speed of the drive shaft. Therefore, if the shoe 92*a* is mainly comprised of a ferrous metal such as SUJ2 according to JIS having a large specific gravity, the mass of the shoe 92*a* becomes large and the swash plate 91, especially at the front edge A, is easily worn. When employing a swash plate 91 formed with a coating for improving the slidability on the swash plate substrate, the coating is easily worn. As opposed to this, if the shoe 92*a* is mainly comprised by a resin having a small specific gravity, the mass of the shoe 92*a* is small and the swash plate 91, in particular the coating, will not be easily worn.

Figure 4:
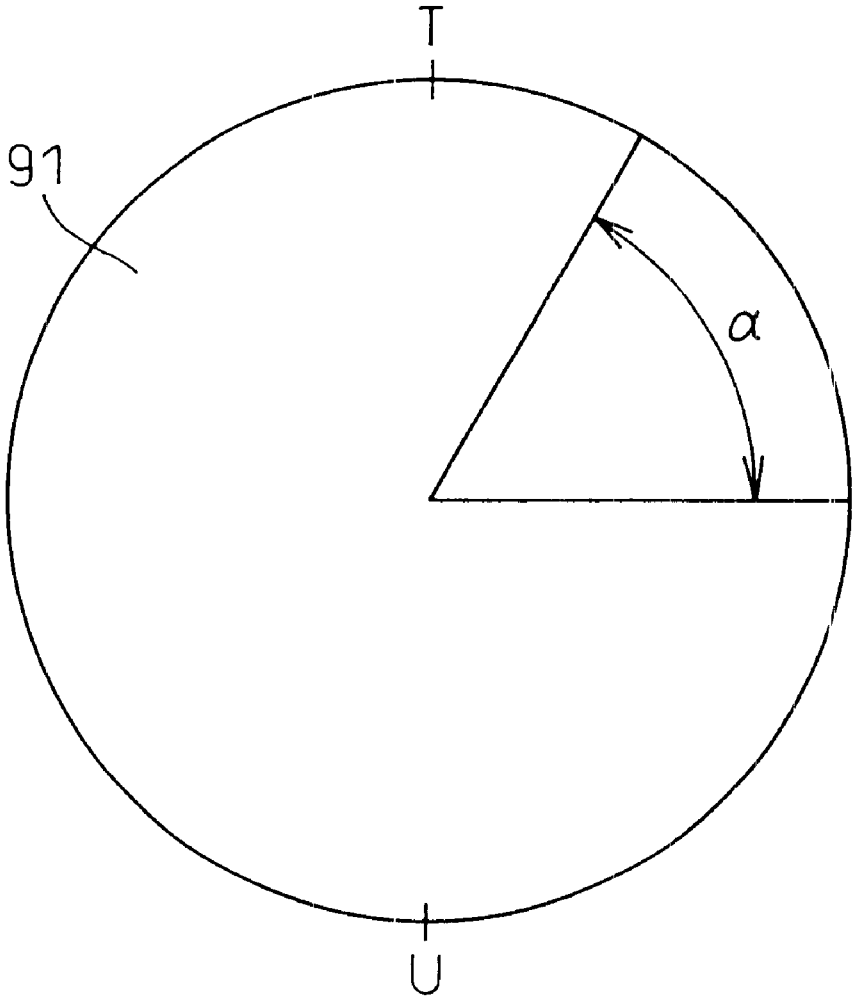
FIG. 4 is a schematic plan view of a swash plate, seen from the rear and in the axial direction, according to a general variable displacement single-headed piston type swash plate compressor.

Further, a shoe 92*b* at the rear side is pressed against the swash plate 91 by a load corresponding to the rotational angle. At this time, a differential pressure based on the difference between the pressure inside the compression chamber and the pressure inside the crank chamber and an inertia based on the weight of the shoe 92*b* itself act on the rear side shoe 92*b*. The resultant force of the differential pressure and the inertia becomes the load. The differential pressure does not change due to the specific gravity of the shoe 92*b*, but the inertia changes due to the specific gravity of the shoe 92*b*, so the load by which the rear side shoe 92*b* is press-contacted against the swash plate 91 changes depending on the specific gravity of the shoe 92*b*. This load changes according to the rotational angle. As shown in FIG. 4, when the load becomes 0 or minus (in the rear direction) at the start of the angular range "α" between the top dead center T and bottom dead center U, the rear side shoe 92*b* separates from the swash plate 91. When the load becomes a plus one (in the forward direction) at the end of the angular range "α", the rear side shoe 92*b* strikes the swash plate 91. Here, the energy E when the shoe 92*b* strikes the swash plate 91 is expressed as follows when the mass of the shoe 92*b* is "m" and the speed of the shoe 92*b* is "v":

$$E=\frac{1}{2}mv^2$$

Therefore, a difference arises in the energy E depending on the mass of the shoe 92*b*.

Therefore, if the shoe 92*b* is mainly comprised of a ferrous metal having a large specific gravity such as SUJ2 of the Japanese Industrial Standard (JIS), since the mass of the shoe 92*b* is large, the energy when the shoe 92*b* strikes the swash plate 91 is large and the swash plate and, in particular, the coating is easily worn. As opposed to this, if the shoe 92*b* is mainly comprised by a resin having a small specific gravity, since the mass of the shoe 92*b* is small, the energy received when the shoe 92*b* strikes the swash plate 91 is small and the swash plate, in particular and, the coating are not easily worn.

Therefore, in this single-headed piston type swash plate compressor, it is possible to achieve an even more superior durability.

Next, a specific embodiment of the present invention will be explained with reference to the drawings.

In the variable displacement single-headed piston type swash plate compressor of the present embodiment (hereinafter referred to simply as a "compressor"), as shown in FIG. 1, a front housing 2 is connected to the front end of a cylinder block 1. A crank chamber 2*a* is formed in the cylinder block 1 and the front housing 2. A rear housing 4 is connected to the rear end of the cylinder block 1 through a valve mechanism 3 comprised of suction valves, valve plate, discharge valves, and retainers. A suction chamber 4*a* and a discharge chamber 4*b* are formed in the rear housing 4. The suction chamber 4*a* is connected to a not shown evaporator, the evaporator is connected through a not shown expansion valve to a not shown condenser, and the condenser is connected to the discharge chamber 4*b*.

A drive shaft 5 is rotatably supported at the front housing 2 and the cylinder block 1 through bearings 2*b*, 1*b*. A plurality of cylinder bores 1*a* parallel with the axis of the drive shaft 5 are formed in the cylinder block 1. A single-headed piston 6 is accommodated in each cylinder bore 1*a* to reciprocate therein.

A rotor 7 is fixed to the drive shaft 5 so as to be able to rotate in the crank chamber 2*a* through a bearing 2*c* adjacent to the front housing 2. The swash plate 8 is oscillatingly provided on the rotor 7 through a pair of hinge mechanisms K. A through hole 8*a* is formed in the swash plate 8. The drive shaft 5 is inserted through the through hole 8*a* while allowing an oscillating movement of the swash plate 8. A pair of shoes 9*a*, 9*b* are provided at the front and rear of the swash plate 8. The pistons 6 are engaged with the swash plate 8 through each pair of shoes 9*a*, 9*b*. The pair of shoes 9*a*, 9*b* sandwiches the swash plate 8, and the flat surfaces of the shoes 9*a*, 9*b* contact the front and rear surfaces of the swash plate 8. The spherical surfaces of the shoes 9*a*, 9*b* contact a pair of the spherical shoe seats of the piston 6 to be accommodated therein.

Further, the rear housing 4 accommodates a control valve 10 connected to the suction chamber 4*a*, the discharge chamber 4*b*, and the crank chamber 2*a*. By adjusting the pressure in the crank chamber 2*a* by the control valve 10, it becomes possible to change the inclination angle of the swash plate 8 and to adjust the discharge capacity.

Figure 2:
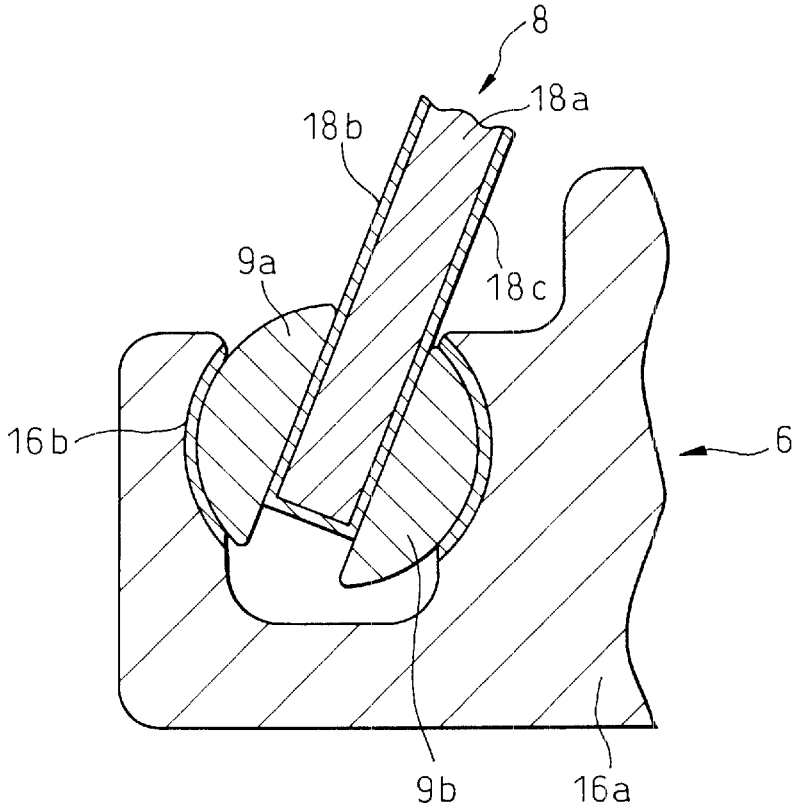
FIG. 2 is an enlarged sectional view of the principal parts of a variable displacement single-headed piston type swash plate compressor according to an embodiment of the present invention.

In the compressor of the above embodiment, as shown in FIG. 2, the swash plate 8 is comprised of a swash plate substrate 18*a* made of a ferrous metal and coatings 18*b*, 18*c* comprised of an aluminum sprayed layer and a resin coat formed on the front and rear surfaces of the swash plate substrate 18*a*. The structure shows a further formation of the latter coating on the former coating. Further, each of the front side and rear side shoes 9*a*, 9*b* is comprised of a resin or an oil-containing foamed resin. Further, each piston 6 is comprised of a piston substrate 16*a* made of an aluminum-based material and a coating 16*b* made of tin plating formed on the shoe seat of the piston substrate 16*a* .

Here, the ferrous material of the swash plate substrate 18*a* is SUJ2. The "aluminum sprayed layer" means a sprayed layer using Al-Si alloy as the aluminum-based material. The "resin coat" means a coating layer obtained by dispersing $MoS_2$ and graphite in PAI. Further, the resin of the shoes 9*a*, 9*b* is a phenol resin. The oil-containing foamed resin is an unspecified resin containing a foaming agent such as a phenol resin made to foam to have continuous pores and impregnated with a lubricating oil in the pores. Further, the aluminum-based material of the piston substrate 16*a* is an Al—Si alloy, for example, A4032 or ADC12.

The compressor configured in this way has a lower weight since the shoes 9*a*, 9*b* are mainly comprised of a resin with a specific gravity of about 1.6.

Further, in this compressor, since the energy with which the shoes 9*a*, 9*b* strike the swash plate 8 is small and the mass of the shoes 9*a*, 9*b* is small, the coatings 18, 18*c* on the swash plate substrate 18*a* will not be easily worn. Therefore, in this compressor, a more superior durability can be achieved.

Further, in this compressor, since the shoes 9*a*, 9*b* are mainly comprised of a resin, the inertia of the shoes 9*a*, 9*b* acting in a direction increasing the inclination angle is small and the high speed control is improved.

Further, in this compressor where the shoes 9*a*, 9*b* are impregnated with a lubricating oil, the slidability between the swash plate 8 and shoes 9*a*, 9*b* and between the shoes 9*a*, 9*b* and the shoe seats of the pistons 6 can be easily secured.

While the invention has been described with reference to specific embodiment chosen for purpose of illustration, it should be apparent that numerous modifications could be made thereto by those skilled in the art without departing from the basic concept and scope of the invention.

The present disclosure relates to subject matter contained in Japanese Patent Application No. 2000-214234, filed on Jul. 14, 2000, the disclosure of which is expressly incorporated herein by reference and in its entirety.

What is claimed is:

1. A single-headed piston type swash plate compressor comprising:

a housing internally defining and forming cylinder bores, a crank chamber, a suction chamber, and a discharge chamber;

a drive shaft driven by an external drive source and supported rotatably by the housing;

a swash plate supported by the drive shaft to be rotated synchronously with the drive shaft;

a single-headed piston accommodated in each of the cylinder bores to be able to reciprocate therein and to define a compression chamber therein; and a pair of shoes provided at the front and rear of the swash plate so as to be accommodated in the piston and to drive the piston; wherein the shoes are mainly comprised of a resin, and at least one of the shoes is impregnated with a lubricating oil.

2. A swash plate compressor as set forth in claim 1, wherein at least one of the shoes is impregnated with a lubricating oil.

3. A swash plat compressor as set forth in claim 1, wherein the inclination angle of the swash plate is variable with respect to the drive shaft, and the pressure in the crank amber can be adjusted by a control valve to change the inclination angle and adjust the amount of discharge capacity.

4. A swash plat compressor as set forth in claim 1 wherein the inclination angle of the swash plate is variable with respect to the drive shaft, the pressure in the crank chamber can be adjusted by a control valve to change the inclination angle and adjust the amount of discharge capacity, and the swash plate is comprised of a swash plate substrate made of a first metal and coatings formed on the front an rear surfaces of the swash plate substrate for improving the slidability with the first metal.

5. A swash plate compressor as set forth in claim 1, wherein the piston is comprised of a piston substrate made of an aluminum-based material and a coating made of tin plating formed on the shoe seat of the piston substrate, and a semi-spherical convex surface of the shoe and a semi-spherical concave surface of the shoe seat slide against each other.

6. A swash plate compressor as set forth in claim 1, wherein the swash plate is comprised of a swash substrate made of a ferrous material and aluminum sprayed layers formed on the front and rear surface of the swash plate substrate, and resin coats are formed on the aluminum sprayed layers.

7. A single-headed piston type swash plate compressor comprising:

a housing internally defining and forming cylinder bores, a crank chamber, a suction chamber, and a discharge chamber;

a drive shaft driven by a external drive source and supported rotatably by the housing;

a swash plate supported y the drive shaft to be rotated synchronously with the drive shaft;

a single-headed piston accommodated in each of the cylinder bores to be able to reciprocate therein and to define a compression chamber therein; and a pair of shoes provided at the front and rear of the swash plate so as to be accommodated in the piston and to drive the piston;

wherein the shoes are mainly comprised of a resin and formed to include continuous pores, and wherein at least a portion of the continuous pores are impregnated with a lubricant.

* * * * *